US007469705B1

(12) United States Patent
Nocella, III

(10) Patent No.: US 7,469,705 B1
(45) Date of Patent: Dec. 30, 2008

(54) UMBRELLA WITH ILLUMINATED SHAFT

(76) Inventor: Anthony Nocella, III, 1101 Somerton La., Chesapeake, VA (US) 23322

( * ) Notice: Subject to any disclaimer, the term of this patent is extended or adjusted under 35 U.S.C. 154(b) by 0 days.

(21) Appl. No.: 11/262,378

(22) Filed: Oct. 31, 2005

Related U.S. Application Data

(63) Continuation-in-part of application No. 10/058,643, filed on Jan. 28, 2002, now abandoned.

(51) Int. Cl.
*A45B 3/02* (2006.01)

(52) U.S. Cl. ..... 135/16; 135/25.4; 135/910; 362/102

(58) Field of Classification Search ..... 135/16, 135/910, 25.4; 362/102, 577
See application file for complete search history.

(56) References Cited

U.S. PATENT DOCUMENTS

| | | | | | |
|---|---|---|---|---|---|
| 1,595,023 | A | * | 8/1926 | Probe | 362/102 |
| 2,087,537 | A | * | 7/1937 | Finkel | 362/102 |
| 2,246,836 | A | * | 6/1941 | Campbell | 362/577 |
| 2,372,471 | A | * | 3/1945 | Campbell | 135/66 |
| 3,275,815 | A | * | 9/1966 | Golaz et al. | 362/577 |
| 4,020,858 | A | * | 5/1977 | Wilson | 135/15.1 |
| 4,425,602 | A | * | 1/1984 | Lansing | 362/186 |
| 4,848,385 | A | * | 7/1989 | Pennella | 135/16 |
| 4,872,468 | A | * | 10/1989 | Cole | 135/16 |
| 5,126,922 | A | * | 6/1992 | Andreasen | 362/577 |
| D336,981 | S | * | 7/1993 | Smith | D3/5 |
| 5,237,765 | A | * | 8/1993 | Vargish, II | 40/545 |
| 5,282,332 | A | * | 2/1994 | Philips | 42/1.08 |
| 5,351,704 | A | * | 10/1994 | Hunnicutt et al. | 135/66 |
| D353,041 | S | * | 12/1994 | Stenberg | D3/5 |
| 5,463,536 | A | * | 10/1995 | Chou et al. | 362/577 |
| 5,493,480 | A | * | 2/1996 | Huang | 362/102 |
| 5,502,624 | A | * | 3/1996 | Tu | 362/102 |
| 5,810,466 | A | * | 9/1998 | Young | 362/102 |
| 5,848,831 | A | * | 12/1998 | Tatsumi | 362/102 |
| 5,960,805 | A | * | 10/1999 | Murphy | 135/16 |
| 6,158,451 | A | * | 12/2000 | Wu | 135/16 |
| 6,237,615 | B1 | * | 5/2001 | Carso et al. | 135/19.5 |
| 2002/0074027 | A1 | * | 6/2002 | Maidment | 135/16 |

FOREIGN PATENT DOCUMENTS

| | | | |
|---|---|---|---|
| JP | 9-322813 | * | 9/1997 |
| JP | 10099113 A | * | 4/1998 |
| JP | 10192021 A | * | 7/1998 |
| JP | 2001-61522 | * | 3/2001 |

* cited by examiner

*Primary Examiner*—Winnie Yip
(74) *Attorney, Agent, or Firm*—John D. Gugliotta, PE, Esq

(57) ABSTRACT

The present invention relates generally to umbrellas and, more particularly, to an umbrella having a reflective shaft comprising batteries for powering a plurality of illuminating tubes surrounding the shaft. The instant abstract is neither intended to define the invention disclosed in this specification nor intended to limit the scope of the invention in any way.

2 Claims, 2 Drawing Sheets

UMBRELLA WITH ILLUMINATED SHAFT

RELATED APPLICATIONS

The present application is a Continuation in Part of U.S. Ser. No. 10/058,643, filed on Jan. 28, 2002, and herein abandoned.

BACKGROUND OF THE INVENTION

1. Field of the Invention

The present invention relates generally to umbrellas and, more particularly, to an umbrella having a reflective umbrella shaft comprising batteries for powering a plurality of illuminating tubes surrounding the shaft.

2. Description of the Related Art

No one can doubt the effectiveness umbrellas have for keeping persons walking in the rain dry. Because umbrellas have proven to be extremely effective over the years, minimal changes have been made to their simple design. Although umbrellas do well keeping persons dry, they do nothing to enhance a person's safety when they are used in dark, rainy conditions. In fact, black and dark colored umbrellas may actually reduce a person's safety by making him or her less visible to approaching motorists. Reduced visibility, coupled with decreased stopping distances, often results in a greater likelihood of these persons being hit, injured or even killed by passing automobiles.

A search of the prior art did not disclose any patents that read directly on the claims of the instant invention; however, the following references were considered related:

U.S. Pat. No. 6,158,451 to Tsuan-Zong and U.S. Pat. No. 4,020,585 to Wilson both teach a lamp device atop an umbrella. U.S. Pat. No. 4,848,385 to Penella, U.S. Pat. No. 2,372,471 to Campbell and U.S. Pat. No. 2,087,537 to Finkel all teach an illuminated umbrella. U.S. Pat. No. 2,246,836 to Campbell discloses an umbrella having an illuminated stick. U.S. Pat. No. 4,872,468 to R. Cole discloses an umbrella having a reflective strip. U.S. Pat. No. 4,425,602 to Lansing describes an umbrella lamp. And, U.S. Pat. No. D353,041 to Stenberg shows a design for a combination umbrella and light.

Consequently, there exists a need for a means that affords persons carrying umbrellas improved visibility and increased safety when weather and lighting conditions are poor.

SUMMARY OF THE INVENTION

It is therefore an object of the present invention to provide an illuminated umbrella for improving the visibility of its person.

It is a specific feature of the present invention to provide an improved umbrella having a reflective shaft, comprising batteries provided to power a plurality of illuminating tubes surrounding the shaft.

Briefly described according to one embodiment of the present invention, an umbrella having an illuminated shaft is provided. The shaft comprises a clear, neon-colored tube. A light source or sources, such as such as incandescent lamps, positioned along the interior of the tube brightly illuminate the person carrying the umbrella to make him or her more visible to approaching motorists. Therefore, when visibility is the poorest, s.a. In dark and rainy conditions, the person carrying the umbrella is more viable and, is accordingly, safer when traveling on foot. The light sources are powered by two AA batteries and are controlled by an on/off switch.

To improve one's visibility be means of an illuminated shaft activated by a switch is quick, easy and effective.

In accordance with a preferred embodiment. The safety of a pedestrian carrying an umbrella on rainy nights is greatly enhanced.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
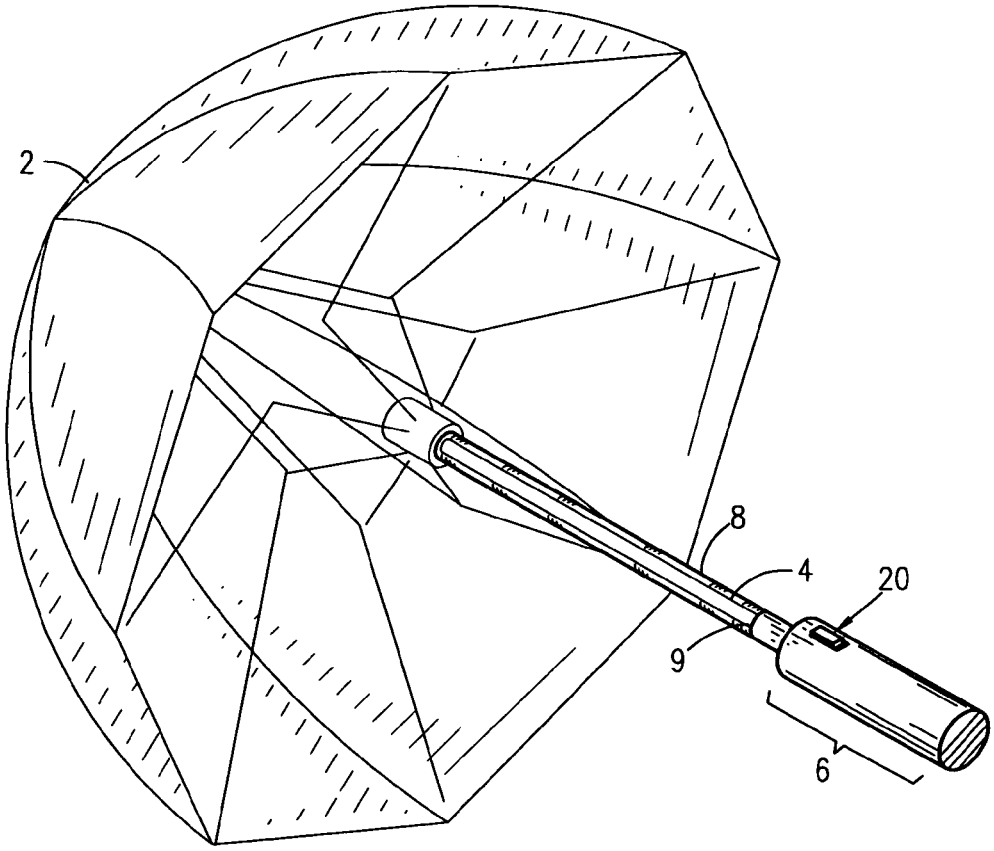
FIG. 1 is a perspective view of an umbrella combination having an illuminated shaft according to the preferred embodiment of the present invention.

Referring now to FIG. 1, an umbrella is shown according to the present invention comprising a retractable head 2, a support shaft 4 and a handle 6. It is envisioned that the retractable head 2 is comprised of various types of flexible, water-repellant materials covered in a variety of patterns. The retractable head 2 and the shaft 4 operate together to alternately extend, lock and retract the head 2 in a manner generally typical of the kinds of umbrellas currently and readily available to consumers. The shaft 4 of the umbrella comprises a clear, neon-colored tube. A means to illuminate the shaft 4 is comprised along the length of the interior of the shaft 4. It is preferred that the means comprise incandescent lamps 8 positioned along the length of the interior of the shaft 4 to brightly illuminate the person carrying the umbrella to make him or her more visible to approaching motorists.

Figure 2:
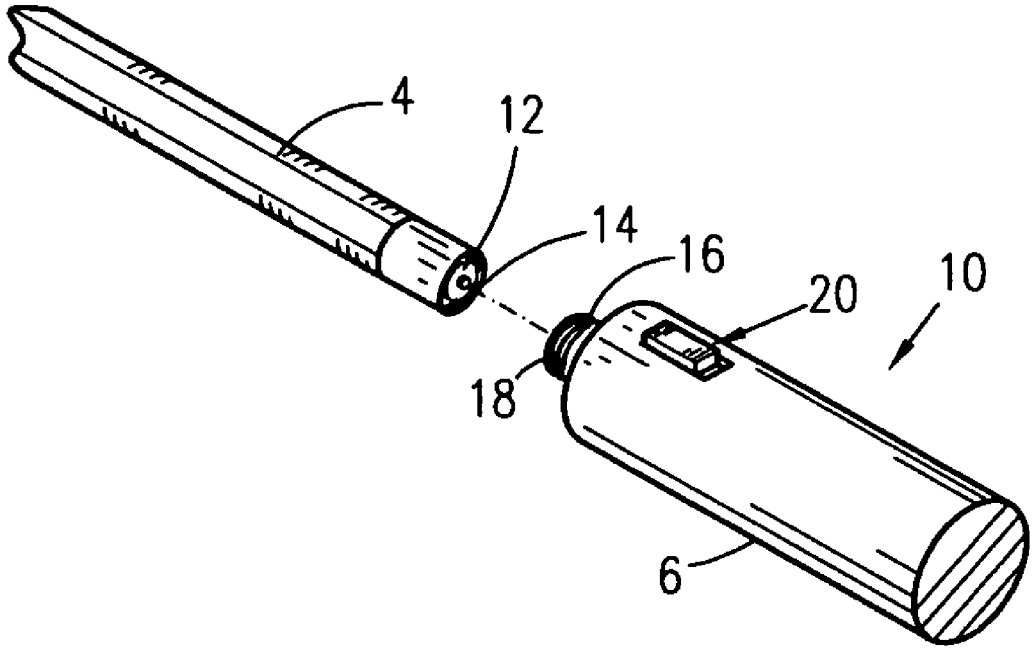
FIG. 2 is a perspective view of the lower end of the shaft in relation to the handle portion of the umbrella.

Referring to FIG. 2, a perspective view of the lower end of the shaft 4 is shown in relation to the handle 6 portion of the umbrella. Because the source that serves as the means to illuminate 8 the shaft 4 is powered by a battery(ies) 12 assembly contained in a cavity formed at the lower end 10 of the shaft 4, the umbrella comprises threads 14, 18 to removably connect the shaft to the handle. The inside rim of the lower end 10 of the shaft 4 comprises internal threads 14 that receive external threads 18 positioned on a screw cap 16. The screw cap 16 extends outwards from the top portion of the handle 6. When the shaft 4 is connected to the handle 6, the battery is proximately located near an on-off switch 20 positioned on the handle 6 provided to activate the illumination source. The switch 20 is connected to the battery assembly 12 by any standard means of connection well known in the art.

2. Operation of the Preferred Embodiment

In operation, and in reference to both FIGS. 1 and 2, the present invention is utilized merely as a normal umbrella; however, the user activates the illumination source by means of an on/off switch when the weather or lighting conditions make visibility poor. To improve one's visibility by means of an illuminated shaft activated by a switch is quick, easy and effective. In this manner, the safety of a pedestrian carrying an umbrella outside on a rainy night is greatly enhanced.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and variations embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. An umbrella, said umbrella comprises:

a shaft, said shaft comprises a neon-colored translucent tube;

a retractable head, said retractable head and said shaft operate together to alternately extend, lock and retract said retractable head;

a lower end comprised on said shaft;

a handle section, said handle section removably affixed to said lower end;

a means for illuminating said shaft, said means for illuminating said shaft comprising at least one incandescent lamp positioned along a length of an interior of said shaft;

a battery assembly contained within said lower end, said battery assembly powers said incandescent lamp; and a switch to activate said incandescent lamp, said switch is connected to said battery assembly by a means for connection.

2. The umbrella of claim 1, wherein said shaft further comprises:

a cavity on the interior portion of said lower end of said shaft;

a series of threads formed along a lower rim of said lower end; and a screw cap extending outwards from a top portion of said handle, said screw cap comprises threads to mate with corresponding threads formed along said lower rim of said shaft such that batteries are removably contained in said battery assembly.

* * * * *